United States Patent [19]

Moss et al.

[11] Patent Number: 4,765,014

[45] Date of Patent: Aug. 23, 1988

[54] FLEXIBLE DUSTER HEAD HOLDER

[75] Inventors: Theron C. Moss; Haymond E. Cross, both of Cleveland, Tenn.

[73] Assignee: Seco Industries, Inc., Cleveland, Tenn.

[21] Appl. No.: 28,219

[22] Filed: Mar. 20, 1987

[51] Int. Cl.[4] ..... A47L 13/252

[52] U.S. Cl. ..... 15/229.3; 15/147 B; 15/210 R; 15/228

[58] Field of Search ..... 15/141 R, 146, 147 R, 15/147 A, 147 B, 160, 172, 206, 209 R, 210 R, 210 A, 228, 229 R, 229 A, 229 AC, 229 AP, 229 B, 229 BC, 229 BP, 154

[56] References Cited

U.S. PATENT DOCUMENTS

| | | | |
|---|---|---|---|
| 2,185,873 | 1/1940 | Underhill | 15/147 A |
| 2,696,015 | 12/1954 | Richter | 15/147 R |
| 3,037,230 | 6/1962 | Strand et al. | 15/229 AC |
| 3,381,334 | 5/1968 | Redmond | 15/229 AC |

*Primary Examiner*—Edward L. Roberts

*Attorney, Agent, or Firm*—Renner, Otto, Boisselle & Sklar

[57] ABSTRACT

A flexible duster head holder includes a stiffener over which a conventional duster head is placed. The stiffener may be bent to conform to the shape of a non-flat surface to be dusted. The stiffener consists of a bendable metal wire core which is sufficiently rigid to hold the shape to which it is bent until being bent to a different shape. Surrounding the core is a resilient vinyl sheath or cover which limits the sharpness of any bend that can be imparted to the stiffener, thereby reducing the likelihood that the wire core will break. Two different methods are described for attaching the stiffener to a clamp assembly. In one, the stiffener is inserted into passages in a mounting block and glued in place; in the other, the stiffener extends all the way through passages in the mounting block, and exposed ends of the wire core are folded over into a U-shape such that the stiffener cannot be withdrawn from the mounting block when the mounting block is secured to the clamp assembly by being received between the arms of a clevis and riveted in place.

19 Claims, 2 Drawing Sheets

FLEXIBLE DUSTER HEAD HOLDER

FIELD OF THE INVENTION

The present invention relates to duster head holders which can be bent to conform to the contours of hard-to-dust objects.

BACKGROUND OF THE INVENTION

Dusters provide a convenient way to clean and remove unwanted dust. While the shape of the duster presents no special problem when it is intended for use on a flat surface such as a floor or wall, flat dusters are not effective in dusting rounded surfaces such as the tops of pipes. It may not be convenient to have a separate duster for each curved or irregularly shaped surface to be encountered. Accordingly, it is desirable to provide a duster head holder which can be readily bent to conform to the surface to be dusted and which will maintain that shape until bent to a new shape.

SUMMARY OF THE INVENTION

The present invention provides a duster head holder which can readily be shaped to conform to curved or other non-flat surfaces. Moreover, the present invention provides a duster head holder of this sort which can repeatedly be reshaped without breaking. To these ends the duster head holder of the present invention includes a shapeable stiffener for a fabric duster head. The stiffener includes a metal wire core and a resilient plastic cover or sheath surrounding the core. This cover or sheath has a thickness proportioned to limit the minimum radius to which the stiffener may be bent. Preferably, the sheath is tubular and has a wall thickness slightly greater than the diameter of the wire core it surrounds. The wire core may be made of steel and the cover of vinyl. There may be a smaller clearance between the wire core and the inside of the cover or sheath.

The stiffener may be mounted to a handle in either of two ways. According to one feature of the invention, the two ends of the stiffener are received in passages in a block. A slight clearance is provided between the stiffener and the passages through the block which is then partially filled with an adhesive to secure the stiffener in place. In the alternative, the tubular cover can be removed from the end portions of the stiffener to expose a short portion of the wire core. The end portions of the stiffener are then inserted into the passages through the block so that the exposed wire core ends extend all the way through the block. These wire core ends are then bent around a 180° bend and pressed into grooves in the exterior of the block. In either case, the block can be secured to a clamp assembly with a clevis at one end for receipt of the block and a collet assembly at the other end for gripping the handle.

The invention, then, comprises the features hereinafter fully described and particularly pointed out in the claims, the following description and annexed drawings setting forth in detail certain illustrative embodiments of the invention, these being indicative, however, of but a few of the various ways in which the principles of the invention may be embodied.

DESCRIPTION OF THE PREFERRED EMBODIMENTS

Figures 1, 2, 4, 5:
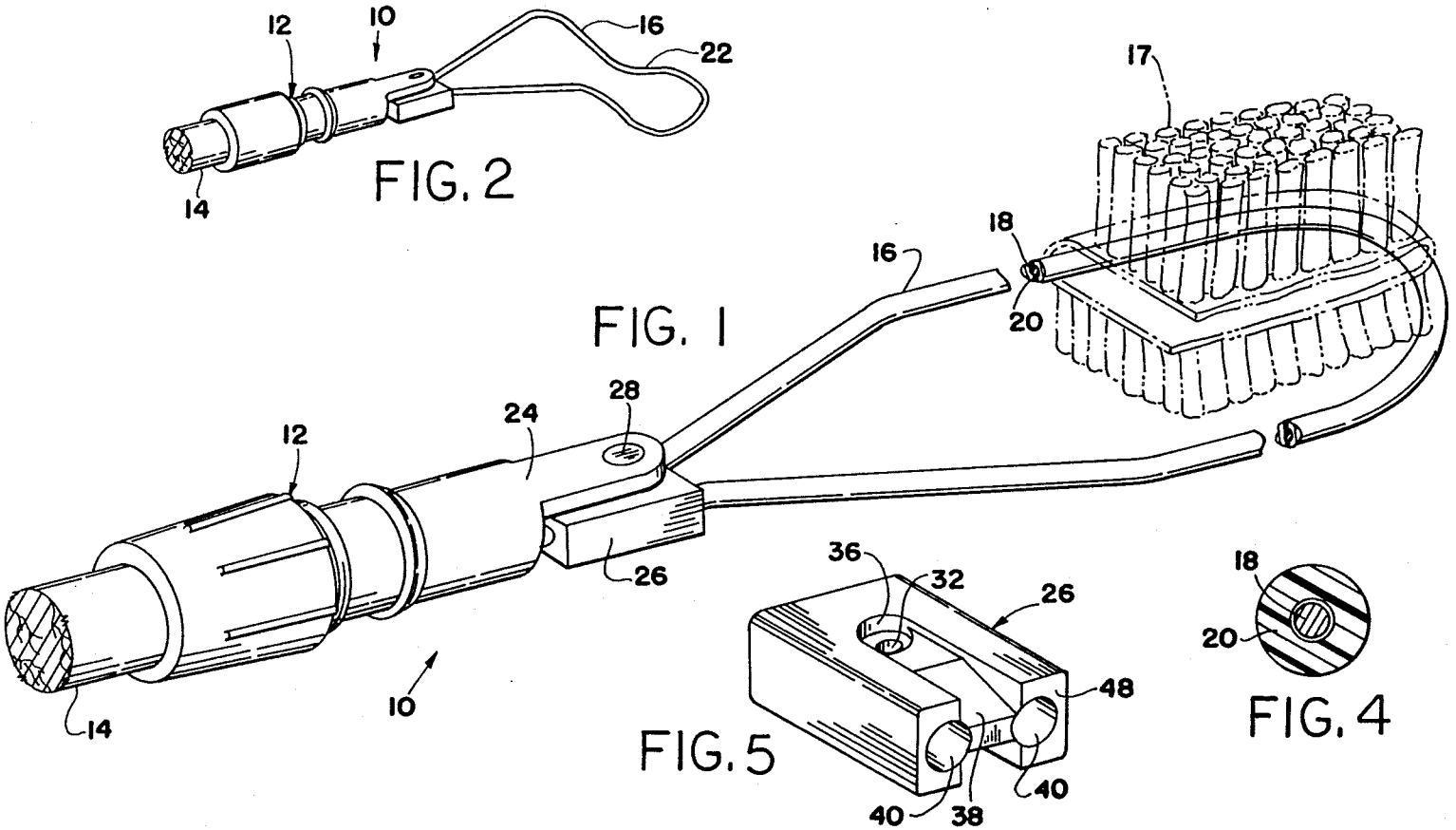
FIG. 1 is a perspective illustration of a flexible duster head holder constructed in accordance with the present invention.
FIG. 2 is a view similar to FIG. 1 on a reduced scale and showing the flexible holder bent to a different shape from that illustrated in FIG. 1.
FIG. 4 is an enlarged transverse section through the stiffener portion of the holder of FIG. 3, taken generally along the plane of the line 4—4 thereof.
FIG. 5 is an enlarged perspective illustration of a mounting block forming a part of the flexible holder of FIG. 1.

The duster head holder 10 shown in FIG. 1 is constructed in accordance with the present invention. Broadly, the holder 10 includes a clamp assembly 12, a handle 14 connected to one end of the clamp assembly, and a stiffener 16 connected to the other end of the clamp assembly. The stiffener 16 is proportioned to receive a conventional dust head (duster) 17, a portion of which is shown in phantom lines in FIG. 1 surrounding the stiffener. The duster head may be secured to the holder in any suitable manner, as by conventional tie strings or the like (not shown). The stiffener 16 is flexible so that it can be bent to conform to the shape of irregular or non-flat surfaces such as pipes, or to reach into otherwise inaccessible locations. FIG. 2 illustrates the holder 10 with its stiffener 16 bent to conform to an irregularly shaped object. This is but one of a number of shapes into which the stiffener 16 can be bent according to the particular area or article to be dusted. The stiffener 16 is constructed in such a manner, discussed below, that when it is bent to a particular shape, it will retain that shape until bent to another shape, and will withstand repeated bendings without breaking.

The stiffener 16 is formed of a wire core 18 (FIG. 4) surrounded by a resilient plastic cover or sheath 20. The wire core 18 is preferably made of a steel wire, although other metals are possible. It is only necessary that the metal be bendable by hand and sufficiently rigid to retain its shape during use or until intentionally bent to another shape. In a preferred embodiment the wire has a diameter of between 0.117 and 0.120 inch.

The sheath 20 surrounding the wire core 18 limits the minimum radius, e.g. radius 22 (see FIG. 2) to which the wire core can be bent. This protects the wire core 18 from being bent to an excessively sharp angle which might tend to promote breakage. The thickness of sheath 20 makes it unlikely that the core can be bent so sharply that it will fracture, even after repeated bendings.

The sheath 20 is preferably formed of vinyl which is extruded in a tubular form. Once the sheath 20 has been extruded, the wire core 18 is inserted into it. A small clearance is provided between the inside surface of the sheath 20 and the outside surface of wire 18 (see FIG.

4). In the case where the wire core has a diameter between 0.117 and 0.120 inch, the inside diameter of the sheath may be approximately 0.128 inch.

The sheath 20 may have a radial wall thickness somewhat greater than the diameter of the wire core 18. Thus in the above example (wire core 0.117–0.120 inch) the outside diameter of the sheath is about 0.375 inch. This wall thickness has proven effective in limiting the minimum radius to which the wire core can be bent so as to prevent or limit fatigue failure arising from repeated bending of the stiffener 16.

The clamp assembly 12 serves to mount the stiffener 16 to the handle 14 and is desirably formed of a suitable plastic material which includes a clevis shaped end portion 24 and a mounting block 26 adapted to fit therein. A pin or rivet 28 extends through a passage 30 in the clevis and a corresponding passage 32 in the mounting block 26 which aligns with the passage 30 when the block is in the clevis (see FIG. 3). Passage 30 through the clevis 24 may be reinforced by collars 34 which surround and form extensions of the passages 30. The collars 34 extend inwardly toward each other from opposite arms of the clevis 24 and are received in corresponding recesses 36 (FIG. 5) in the mounting block 26. Mounting block 26 includes ramps 38 on opposite sides of the block (only one ramp shown) on which collars 34 ride as the mounting block is inserted into the clevis 24. The ramps 38 spread the clevis to permit assembly of the mounting block 26 therebetween.

The mounting block 26 shown in FIG. 5 includes two parallel passages 40 which extend all the way through the block in a plane generally perpendicular to the longitudinal axis of passage 32, with the passages 40 in spaced relation on opposite sides of passage 32. The end portions 44 (FIG. 6) of the stiffener 16 are inserted into the passages 40. A small clearance 46 is provided between the outside diameter of the vinyl sheath 20 and the passages 40. To secure the stiffener 16 to the mounting block 26, the end portions 44 of the stiffener are inserted into the passages 40 so that the end portions 44 stop short of end face 48 of the mounting block. Then an adhesive 50 is applied which fills the balance of the passages 40 and partially fills the space 46 between the outside of the stiffener 16 and the passages 40.

Figures 3, 6, 7, 8:
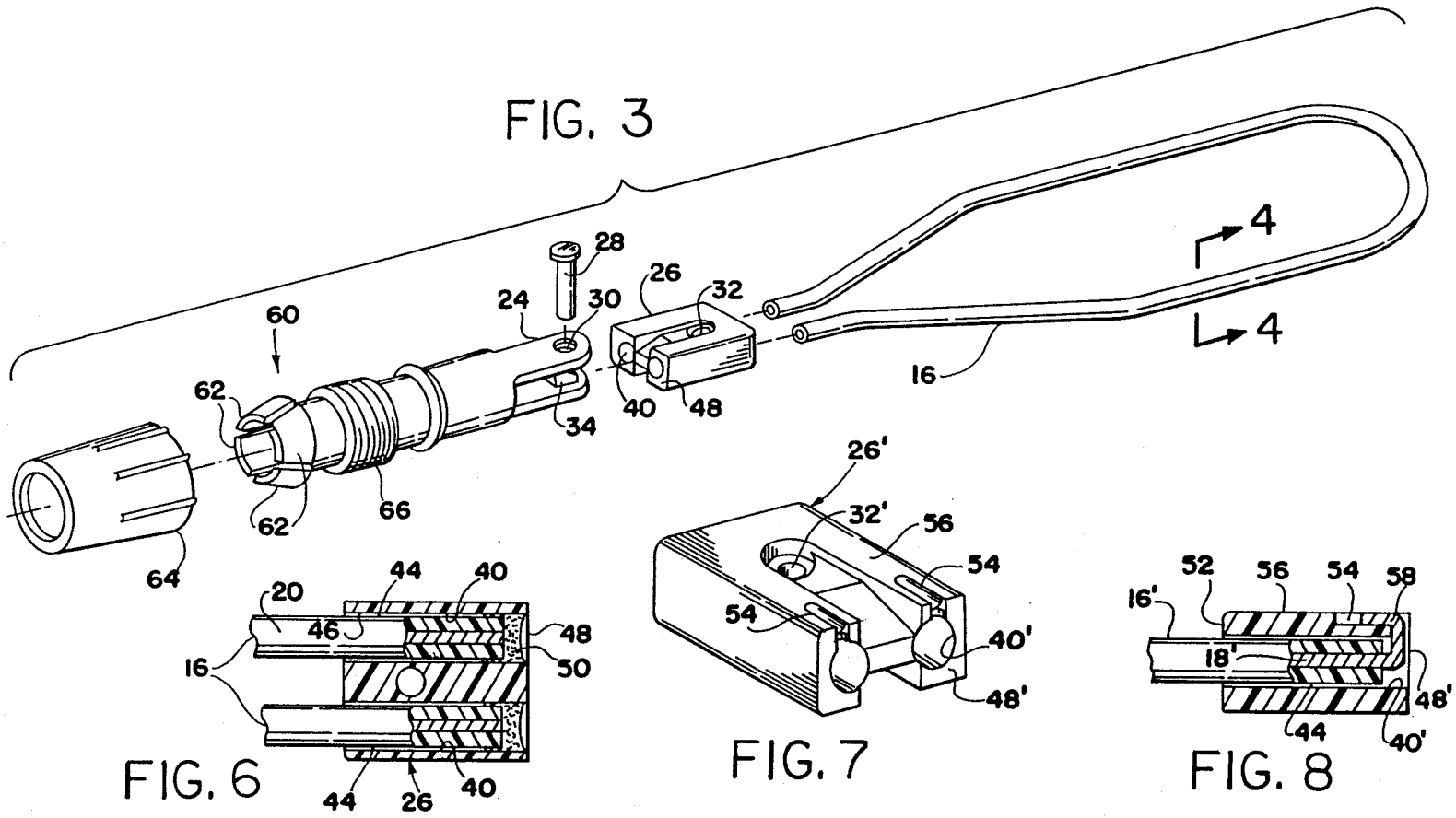
FIG. 3 is an exploded view of the flexible holder of FIG. 1.
FIG. 6 is a fragmentary longitudinal section through the mounting block of FIG. 5 showing both of the stiffening wires mounted therein.
FIG. 7 is a perspective illustration of a second embodiment of the mounting block of FIG. 5.
FIG. 8 is a fragmentary longitudinal section through the block of FIG. 7 showing one of the stiffening wires mounted therein.

A second technique for securing a stiffener 16' to a mounting block 26' is illustrated in FIGS. 7 and 8, wherein the same reference numerals followed by a prime symbol are used to designate like parts. Block 26' has passages 40' which extend through it from end face 48' to the opposite end face 52. The mounting block 26' includes generally L-shaped channels 54 which extend outward from the passages 40' along end face 48' and then turn 90° and extend along a side surface 56.

To mount the stiffener 16' in block 26', it is first necessary to strip away the plastic cover or sheath 20' exposing an end portion 58 of the core wire 18'. The ends of the stiffener are then inserted into the passages 40' through the mounting block 26' until the end portions 58 of the core wire 18' extend beyond the end face 48'. Then, the end portions 58 of the core wire are bent through a 180° turn pressing them tightly into the channels 54. This tight fit prevents the stiffener from being removed from the mounting block 26' when inserted into the clevis 24 and secured by the pin or rivet 28 in the manner previously described. The close clearance between the end face 48' and side face 56 of the mounting block 26' and adjacent surfaces of the clevis retains the bent end portions 58 of the core wire 18' in the channels 54 and prevents rotation of the mounting block relative to the clevis. Clamp assembly 12 (FIG. 1) may then be attached to the handle 14 as by providing internal threads (not shown) in the clamp assembly into which male threads of a conventional handle 14 may be screwed to secure the handle 14 to clamp assembly 12. To prevent rotation of mop handle 14 with respect to the clamp assembly 12, a collet assembly 60 is provided. The collet assembly 60 (FIG. 3) includes a plurality of split fingers 62 and a collar 64. The collar 64 may be screwed onto threads 66 formed on the outside of the clamp assembly 12, and when screwed into place, the collar assembly 64 forces the split fingers radially inward to grip the handle, in a conventional manner.

In use, the stiffener 16 (or 16') may be bent to conform to various odd or non-flat surfaces which need dusting. The inner wire core 18 enables the stiffener to retain the shape to which it is bent. The outer resilient plastic sheath 20 prevents the wire core from being bent at too sharp an angle. Although it may be possible to bend the stiffener 16 at a very sharp angle where it comes out of the mounting block 26, even if the wire core 18 fractures at that point, the plastic sheath is sufficiently rigid to keep the broken pieces of the wire core in such alignment with one another to permit the duster head 10 to be used.

Although the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the claims.

What is claimed is:

1. A duster head holder comprising a shapeable stiffener for a fabric duster head, said stiffener including a metal wire core means bendable by hand into different shapes, said core means being sufficiently rigid to retain the shape into which said core means is bent by hand during use of said holder, and a resilient plastic cover means surrounding said core means, said resilient plastic cover means having sufficient thickness to limit the minimum radius to which the stiffener may be bent whereby the cover means resists breaking of the core means due to bending.

2. The holder of claim 1 wherein said cover means is tubular and has a wall thickness is slightly greater than the thickness of said core means.

3. The holder of claim 2 wherein there is a space between the outer diameter of said core means and the inside of said tubular cover means.

4. The holder of claim 1 wherein said core means is steel and said resilient cover is vinyl.

5. The holder of claim 3 wherein said cover means has an outside diameter of about 0.375 inch and an inside diameter of about 0.128 inch.

6. The holder of claim 4 wherein said core means has a diameter of between 0.117 and 0.120 inch.

7. The holder of claim 1 further comprising mounting means for mounting said stiffener to a handle, said stiffener being of generally U-shape including a pair of end portions, and said mounting means including a block with passages therethrough for receipt of said stiffener end portions, and means for securing said stiffener end portions in said passages.

8. The holder of claim 7 wherein said means for securing said stiffener end portions comprises an adhesive material.

9. A duster head holder comprising a handle, a shapeable stiffener for a mop head and mounting means for mounting said stiffener to said handle, said stiffener including a metal wire core means and a resilient plastic cover means surrounding said core means, said cover means being tubular, with a space between the outer diameter of said core means and the inside diameter of said cover means, said stiffener being of generally U-shape including a pair of end portions, and said mounting means including a block with passages therethrough for receipt of said stiffener end portions, and means for securing said stiffener end portions in said passages.

10. The duster head holder of claim 9 wherein said means for securing said stiffener end portions comprise an adhesive material.

11. The duster head holder of claim 10 wherein said adhesive material at least partially fills the space between each of said passages and the respective stiffener end portions.

12. The duster head holder of claim 9 wherein said core means is bendable by hand into different shapes and is sufficiently rigid to retain the shape into which said core means is bent by hand during use of said holder, and said resilient plastic cover means has sufficient thickness to limit the minimum radius to which the stiffener may be bent, whereby the cover means resists breaking of the core means due to bending.

13. The duster head holder of claim 12 wherein said cover means is an extruded plastic tube having a passage therethrough in which said core means is inserted.

14. A duster head holder comprising a shapeable stiffener for a fabric duster head, said stiffener having a metal wire core shapeable by bending and a resilient plastic cover surrounding said core, said resilient plastic cover having sufficient thickness to limit the minimum radius to which the stiffener may be bent whereby the cover resists breaking of the core due to bending, mounting means for mounting said stiffener to a handle, said stiffener being of generally U-shape including a pair of end portions, and said mounting means including a block with passages therethrough for receipt of said stiffener end portions, and means for securing said stiffener end portions in said passages, said passages extending substantially straight through said block, and said means for securing said stiffener end portions in said passages including channel means extending from said passages and at an angle thereto for receiving a part of said stiffener end portions received in the respective passages, and a clevis in which said block is mounted, said clevis having surface areas which retain said stiffener end portions within said channel means.

15. The holder of claim 14 wherein the part of each of said stiffener end portions which is received in said channel means has said cover removed from said core, said channel means being proportioned to receive said core but being too small to receive said cover.

16. A dust head holder comprising a handle, a shapeable stiffener for a mop head and mounting means for mounting said stiffener to said handle, said stiffener being of generally U-shape including a pair of end portions, and said mounting means including a block with passages therethrough for receipt of said stiffener end portions, and means for securing said stiffener end portions in said passages, said passages extending substantially straight through said block, and said means for securing said stiffener end portions in said passages including channel means extending from said passages and at an angle thereto for receiving a part of said stiffener end portions received in the respective passages.

17. The duster head holder of claim 16 wherein said stiffener includes an inner wire and a sheath surrounding said wire, said channel means being proportioned to receive said wire, but being too small to receive said sheath.

18. A duster head holder comprising a shapeable stiffener for a fabric duster head, said stiffener having a metal wire core shapeable by bending and a resilient plastic cover surrounding said core, said resilient plastic cover having sufficient thickness to limit the minimum radius to which the stiffener may be bent whereby the cover resists breaking of the core due to bending, said cover having an outside diameter of about 0.375 inch and an inside diameter of about 0.128 inch, and said core having a diameter of between 0.117 and 0.120 inch, and mounting means for mounting said stiffener to a handle, said stiffener being of generally U-shape including a pair of end portions, and said mounting means including a block with passages, therethrough for receipt of said stiffener end portions, and means for securing said stiffener end portions in said passages.

19. A duster head holder comprising a shapeable stiffener for a fabric duster head, said stiffener having a metal wire core shapeable by bending and a resilient plastic cover surrounding said core, said resilient plastic cover having sufficient thickness to limit the minimum radius to which the stiffener may be bent whereby the cover resists breaking of the core due to bending, said cover being tubular and having a space between the outer diameter of said core and the inside diameter of said cover, and mounting means for mounting said stiffener to a handle, said stiffener being of generally U-shape including a pair of end portions, and said mounting means including a block with passages therethrough for receipt of said stiffener end portions, and means for securing said stiffener end portions in said passages.

* * * * *